United States Patent [19]

Andress et al.

[11] 4,425,230

[45] Jan. 10, 1984

[54] SEPARATION OF MOLYBDENITE FROM ITS MIXTURE WITH OTHER SULFIDE ORES

[75] Inventors: Carlos Andress, Boulder, Colo.; William F. Riggs, Humble, Tex.

[73] Assignee: Oreprep Chemicals, Inc., Houston, Tex.

[21] Appl. No.: 348,923

[22] Filed: Feb. 16, 1982

[51] Int. Cl.[3] ..... B03D 1/14

[52] U.S. Cl. ..... 209/167; 209/166; 252/61

[58] Field of Search ..... 209/166, 167; 252/61

[56] References Cited

U.S. PATENT DOCUMENTS

| | | | |
|---|---|---|---|
| 1,659,396 | 2/1928 | Douglas | 209/166 |
| 1,671,590 | 5/1928 | Keller | 209/166 |
| 1,833,740 | 11/1931 | Derby et al. | 209/166 |
| 2,255,776 | 12/1941 | Janney et al. . | |
| 2,449,984 | 9/1948 | Gibbs | 209/167 |
| 2,559,104 | 7/1951 | Arbiter et al. . | |
| 2,664,199 | 12/1953 | Barker et al. . | |
| 3,137,649 | 6/1964 | Berkeley . | |
| 3,329,266 | 7/1967 | Cox . | |
| 3,375,924 | 4/1968 | Cordett et al. . | |
| 3,788,467 | 1/1974 | Werneke | 209/167 |
| 3,811,569 | 5/1974 | Shirley et al. . | |
| 4,231,859 | 11/1980 | Huiatt et al. | 209/167 |
| 4,316,797 | 2/1982 | Parlman | 209/166 |
| 4,341,715 | 7/1982 | Parlman et al. | 209/455 B |

FOREIGN PATENT DOCUMENTS

| | | | |
|---|---|---|---|
| 1070034 | 1/1980 | Canada . | |
| 1071336 | 2/1980 | Canada . | |
| 2823760 | 12/1979 | Fed. Rep. of Germany | 209/166 |
| 373663 | 6/1932 | United Kingdom | 209/167 |
| 2067098 | 7/1981 | United Kingdom | 209/167 |

OTHER PUBLICATIONS

"Molybdenite Flotation"-U.S. Dept. of Commerce-4/28/78-(which is the publication of U.S. Pat. Appln. S.N. 900,830).

*Primary Examiner*—Bernard Nozick

*Attorney, Agent, or Firm*—Pravel, Gambrell, Hewitt, Kirk & Kimball

[57] ABSTRACT

Dithiocarbonic acid, trithiocarbonic acid, water soluble salts of dithiocarbonic acid or trithiocarbonic acid or mixtures thereof when contacted with a mixed sulfide ore effectively depresses copper and iron sulfides thereby permitting molybdenite to be recovered by froth flotation. In copper concentrates produced by a flotation process, the organic collector reagents adhering to the surface of the copper and iron sulfides may be, and preferably are, stripped by conventional physical or chemical means prior to contacting the copper concentrate with the trithiocarbonate depressants of the invention. However, the trithiocarbonates of the invention have been found to be effective depressants of copper and iron sulfides in concentrates which are not stripped prior to treatment with the depressant.

18 Claims, No Drawings

SEPARATION OF MOLYBDENITE FROM ITS MIXTURE WITH OTHER SULFIDE ORES

BACKGROUND OF THE INVENTION

This invention relates to the recovery of molybdenite from mixed sulfide ores, particularly those of iron and copper, contained in flotation concentrates.

Molybdenum, which occurs in nature as its sulfide ore molybdenite, $MoS_2$, is usually found in association with other metallic sulfides, chiefly those of copper and iron. Molybdenite is usually present as a minor component of such mixed sulfides ores. Molybdenite is commonly recovered as a byproduct of the copper refining process. In the copper refining process the metallic sulfide contained in the ores are concentrated by bulk flotation by employing differential wetting of the mineral surface. Differential wetting of the mineral surface is induced by addition of specific organic collector reagents to aqueous slurries of the finely ground ore.

The first step in the recovery of molybdenite is that of bulk flotation during which the copper and molybdenum sulfides are gathered together in a flotation concentrate which, in the copper refining process, is commonly termed a copper concentrate. The copper concentrate contains the majority of the copper and molybdenum content of the original ores plus some iron sulfides and some portion of the original host rock, usually referred as gangue. The composition of a copper concentrate may vary greatly, but in typical operations such concentrates contain from about 10 to about 35 percent by weight copper, and from about 0.2 to about 5 percent by weight molybdenum.

While many processes exist for separation of molybdenite from a copper concentrate, those processes which are most widely used generally consist of three sequential steps. The first step comprises removing the organic collector reagents which were added during the bulk flotation process to render the metallic sulfides hydrophobic. In the second step the stripped copper concentrate is contacted with a reagent to render the copper and iron sulfides hydrophilic relative to the molybdenite. Thereafter, in the third step, molybdenite is differentially floated from the copper-iron sulfides by a process of multi-stage froth flotation and the molybdenite is recovered as an enriched concentrate.

Several procedures, physical and chemical, exist for stripping copper concentrates of organic collectors. Two physical processes which are used are roasting and streaming. Roasting has the drawback that the molybdenite may be oxidized and thus also rendered hydrophilic. In U.S. Pat. No. 2,255,776 various heat treatment processes, including steaming, are described for stripping copper concentrates. U.S. Patent application Ser. No. 900,830 describes the stripping of organic collectors by steaming in the presence of activated carbon. Chemical processes used to strip the copper concentrate of organic collector reagents include leaching under acidic conditions, as described in U.S. Pat. No. 2,664,199, or the addition of oxidizing agents to the copper concentrate as described in U.S. Pat. No. 2,559,104. The most commonly used oxidizing agent is hydrogen peroxide, which may be used alone, as described in U.S. Pat. No. 3,137,649, or in the presence of soluble metal salts, as described in U.S. Pat. No., 3,811,569.

After stripping, the stripped concentrate is contacted with a reagent, usually referred to as a copper depressant, which renders the copper sulfides hydrophilic relative to the molybdenite. Several reagents are currently used, either alone or in combination. But each of the conventionally used depressants have a number of disadvantages. The most common depressant reagents are sulfides, or hydrosulfides of ammonia or alkali metals, particularly sodium hydrosulfide and ammonium sulfide. These widely used reagents are effective copper depressants, but they are susceptible to oxidation which destroys their activity. As a result, such reagents must be used in large quantities to be effective, typically from about 5 to about 35 pounds per ton of copper concentrate. The effectiveness of the hydrosulfide ion can be improved by employing flotation conditions which avoids its oxidation. An effective means to accomplish this is to substitute an inert gas, such as nitrogen as described in Canadian Pat. No. 1,070,034, for the air normally used in flotation. However, use of inert gases requires the addition of a specialized plant to produce the large volume of inert gas required, hence increases the cost of molybdenite recovery.

U.S. Pat. No. 2,664,199 describes the use of sodium ferrocyanide as a copper depressant. But sodium ferrocyanide is only effective when added to copper concentrates in which the predominant copper mineral is chalcocite, $Cu_2S$. It is less effective when used to treat cahlcopyrite, $CuFeS_2$. Because of this, sodium ferricyanide is sometimes used with sodium ferrocyanide or alone or chalcopyrite. Nokes' reagent, which is the unisolated product of the reaction between $P_2S_5$ and NaOH, as described in U.S. Pat. No. 3,375,924, is another copper depressant presently in use. However, Nokes reagent is not widely used because of the continual need to prepare the reagent, its potential safety hazard in preparation and the relatively high cost of its ingredients. Cyanide ion, in the form of one of its soluble salts, is also used as a depressant for copper and iron. But, its extreme toxicity to man and aquatic life limits its use. Several organic reagents have been proposed, or find limited use as copper depressants. One is thioglycolic acid, while U.S. Pat. No. 3,329,266 describes the use of the xanthate formed by the reaction of carbon disulfide and hydroxy acetic acid. Organic reagents are generally ineffective when used alone, and usually require the addition of another depressant such as cyanide. Further, for such reagents to be effective as copper depressants the copper concentrate may require stripping of the collectors before addition of the reagent.

Of the three step sequence discussed above, that step which is most important to obtaining separation of molybdenite from a copper concentrate is the step of adding a copper depressant reagent. The separation of molybdenite is very tedious unless a reagent is added to render the copper sulfides hydrophilic.

SUMMARY OF THE INVENTION

This invention relates to the discovery of a new reagent which may be employed as a copper depressant comprising dithiocarbonic acid, trithiocarbonic acid or water soluble salts of dithiocarbonic or trithiocarbonic acids.

We have discovered that trithiocarbonic acid and water soluble salts of trithiocarbonic acid are effective copper depressants which do not produce the problems inherent in the use of depressants known to the current art. Copper depressants comprised of trithiocarbonic acids or water soluble salts thereof are effective when used with chalcocite, chalcopyrite, bornite, covellite and other types of sulfide ores containing molybdenite. Trithiocarbonic acid and especially the water soluble salts of trithiocarbonic acid are relatively stable to oxidation, and present no known hazard to man or his environment. Further, we have found that the effectiveness of trichiocarbonic acid or its water soluble salts as copper depressants does not depend upon prior stripping of the copper concentrate of its organic collector reagents.

The process of this invention comprises contacting a copper concentrate with trithiocarbonic acid or preferably, a water soluble salt of trithiocarbonic acid, permitting the treated concentrate to condition for a period of time to effective depression of copper and iron sulfides, and subjecting the conditioned, treated copper concentrate to a plurality of sequential froth flotation steps to effect separation and concentration of molybdenite. Although it is not required for the practice of this invention, it is preferred that the copper concentrate be stripped of organic collector reagents prior to contacting the concentrate with the trithiocarbonic acid or water soluble salts thereof to depress copper.

DETAILED DESCRIPTION OF THE PREFERRED EMBODIMENT

When a molydenite of bearing flotation concentrate is contacted with trithiocarbonic acid or, preferably a water soluble salt of trithiocarbonic acid other metallic sulfides, particularly those of copper, are effectively depressed thus permitting molybdenite to be efficiently separated by froth flotation. Such depressants are particularly suitable for depression of the copper and iron content of a copper concentrate.

Trithiocarbonic acid salts which are suitable reagents for application to a copper concentrate within the scope of this invention particularly include single, double or mixed double salts of the alkali metals, salts of the alkaline earth metals, and single or double ammonium salts. Mixed double salts of ammonium and an alkali metal are also suitable copper depressants. Of the alkali metal salts of trithiocarbonic acid, the preferred salts are those of sodium and potassium. Particularly preferred as copper depressants are the double salts of sodium or potassium, such as disodium trithiocarbonate ($Na_2CS_3$), dipotassium trithiocarbonate ($K_2CS_3$) and potassium sodium trithiocarbonate ($KNaCS_3$). Of the alkaline earth metal salts, the preferred salts are magnesium trithiocarbonate ($MgCS_3$) and calcium trithiocarbonate ($CaCS_3$). Generally, alkali metal trithiocarbonates have a greater water solubility, hence are the preferred copper depressants for practice of the invention. The most preferred salt for practice of the invention is disodium trithiocarbonate.

Trithiocarbonate salts may readily be prepared by reacting carbon disulfide with the hydroxides, sulfides or hydrosulfides of the desired alkali or alkaline earth metals or of ammonium. The preferred dialkali metal salts of trithiocarbonic acid may conveniently be prepared by reacting carbon disulfide with an alkali metal hydroxide and an alkali metal hydrosulfide in equal molar proportions. Disodium trithiocarbonate, for instance, may be produced by adding carbon disulfide to a 40 percent aqueous sodium hydrosulfide solution with agitation, followed by addition of sodium hydroxide. Preferably, carbon disulfide is added in not more than about an equal molar amount such that sodium hydrosulfide is preferably present in at least a slight excess relative to carbon disulfide. Thereafter, sodium hydroxide, as a 50 percent aqueous solution is added to the sodium hydrosulfite-carbon disulfide solution in at least an equal molar amount. The reaction is exothermic, hence the reagents should be metered into the reaction solution at rates such that the reaction temperature preferably does not exceed about 120° C. Water may be added, as necessary, during the course of the reaction to dissolve any precipitate that might form. The final product is an aqueous solution of disodium trithiocarbonate which is suitable for use as a copper depressant without further treatment.

Alkaline earth metal salts of trithiocarbonic acid and preferably produced by the reaction of carbon disulfide with an alkaline earth metal sulfide. Ammonium salts of trithiocarbonic acid may be produced by reacting carbon disulfide with either ammonium sulfide or with an equal molar mixture of ammonium hydrosulfide and ammonium hydroxide.

The trithiocarbonates may be used in the practice of this invention under a wide variety of conditions, and particularly under the operating conditions found in most copper refining processes. As previously mentioned, the copper concentrate is generally stripped of organic collector reagents prior to the addition of a copper depressant. Although, in the practice of this invention it is preferred to strip the copper concentrate before contacting it with the trithiocarbonate depressants, prior stripping is not essential to the practice of this invention. Stripping does increase the efficiency of the trithiocarbonates as copper depressants, but the trithiocarbonates of the invention will effectively depress copper even in the absence of prior stripping. Other reagents commonly used in copper-molybdenum processing, such as an oil to collect the molybdenite or frothing agents to improve the froth, may also be used in the practice of this invention without impairing the ability of trithiocarbonates to depress copper.

The process of the invention is applicable to any molybdenite bearing copper concentrates. Copper concentrates produced by an operating copper concentrator are typically slurries having a solids or pulp content of from about 10 to about 30 percent by weight. Such concentrates may be treated directly with the trithiocarbonates, but preferably the concentrate is first thickened to a solids content of from about 40 to about 65 percent by weight. The thickened copper concentrate will then typically contain from about 10 to about 35 percent weight copper, from about 0.2 to about 5.0 percent weight molybdenite and will also contain some iron sulfide and gangue. However, the process of the invention is also applicable to copper concentrates having higher or lower analysis than noted above.

The concentrate may be treated directly with the trithiocarbonate depressants. However, preferably the concentrate is first stripped and thereafter contacted with the trithiocarbonate depressants. The pH of the copper concentrate may vary between about 5 to about 12, but preferably the pH is maintained in a range of from about 7 to about 10 when contacted with the trithiocarbonate depressants. Under normal conditions a copper concentrate which has previously been acidified to a pH of from about 2.0 to about 7.0, and preferably from about 5.5 to about 6.5, upon addition of the trithiocarbonate depressant, will yield a pH of from about 7 to about 10 without further adjustment. The trithiocarbonate depressants of the invention are operative over all temperature ranges typically encountered with copper concentrates. Hence, the concentrate may be treated at temperatures which vary from ambient up to those temperatures produced by steam stripping, namely about 40° C. or higher.

The amount of the trithiocarbonate depressant required for the most effective treatment of the copper concentrate will depend upon the physical properties and copper content of the concentrate under treatment. The trithiocarbonate depressants are effective when added in amounts from about 0.25 to about 50 pounds of trithiocarbonate per ton of the solids content of the concentrate. The depressants are also effective at rates exceeding 50 pounds per ton, but for concentrates of typical composition such higher rates are not required nor are they economically justified. Normally, copper concentrates may be effectively treated with the trithiocarbonates at rates of from about 0.5 to about 15 pounds per ton. In cases where the copper concentrate is stripped of its organic collector reagent prior to contact with the trithiocarbonate depressants then addition of the depressant in amounts ranging from about 1 to about 5 pounds per ton will generally achieve efficient depression of copper. In cases where the copper concentrate is neither stripped of its organic collector reagents nor acid treated prior to addition of the trithiocarbonate depressants, higher rates of addition, generally from about 5 to about 15 pounds per ton, may be required to achieve a comparable degree of molybdenite separation.

As a matter of convenience the alakli earth metal trithiocarbonate depressants are prepared as aqueous solutions ranging from about 30 to about 50 percent by weight in strength. As such, the depressant may be added to the copper concentrate in bulk or as a number of smaller amounts at successive stages in the multiple stage froth flotation process by which molybdenite is recovered. After addition of the trithiocarbonate depressant to the copper concentrate, the concentrate should be allowed to condition for a period of time. The length of time for conditioning is not critical. Normally, full conditioning is completed within from about one-half to about 30 minutes. Generally, conditioning is effectively achieved in about 5 minutes after the addition of the depressant.

After conditioning with the depressant the treated concentrate is subjected to froth flotation during which molybdenite is differentially floated from the depressed copper-iron sulfides and recovered as an enriched concentrate. If desired, an inert gas may be employed to effect flotation. However, since the trithiocarbonate depressants of the invention have a greatly increased resistance to oxidation, use of an inert gas for flotation is not required.

The examples which follow illustrate the practice of the invention under various conditions and are not intended to limit the scope of the invention.

In all of the examples which follow, all bulk rougher flotation tests on the differential flotation of molybdenite from copper and iron minerals were performed in a 1000 gram Denver laboratory flotation cell. Except as otherwise indicated the pH of the copper concentrate was adjusted as noted for each example by addition of a sulfuric acid-water mixture. Following an acid conditioning period disodium trithiocarbonate was added as a copper depressant (except as otherwise noted for example 2K) at the rates indicated (dry weight basis). The pH of the copper concentrate was not further adjusted after addition of the depressant. After addition of the disodium trithiocarbonate depressant, fuel oil was added in an amount from about 0.1 to about 1.0 pounds per ton of concentrate as a collector for molybdenite. Following a conditioning period after depressant addition, molybdenite was differentially floated and collected as an enriched concentrate.

For each of the examples illustrated the copper concentrates consisted of chalcopyrite, chalcocite and pyrite as the primary mineralization and molybdenite as the secondary mineralization. The copper concentrate also contained minor amounts of bornite and covellite. The major reagents used to promote the copper minerals in the production of the copper concentrates of the examples were as follows:

| EXAMPLE SERIES | MAJOR REAGENTS |
|---|---|
| A and C | Potassium amyl xanthate-sodium di-secondary butyl dithiophosphate |
| B and D | Potassium n-butyl xanthate |
| E, F, and K | Potassium n-butyl xanthate and alkyl thiocarbonate |
| G, H, I, and J | Potassium amyl xanthate |

In Table I examples 1A–4A and 1B–3B illustrate the effectiveness of disodium trithiocarbonate as a copper depressant for copper concentrates which were neither acidified nor stripped prior to addition of the depressant. Examples 1D–3D, 1E–2E and 1F–2F illustrate that disodium trithiocarbonate is an effective copper depressant for copper concentrates which are acid conditioned prior to depressant addition. Example 1 C illustrates the use of disodium trithiocarbonate as a depressant in a copper concentrate which was acid conditioned and stripped by addition of zinc sulfate and hydrogen peroxide before addition of the depressant. Examples 1G–2G and 1H–2H illustrate the use of disodium trithiocarbonate on a copper concentrate which was steam stripped, acidified and then treated with the depressant at the elevated temperatures resulting from steam stripping.

TABLE I

| | Copper Concentrate | | | | Molybdenite Concentrate | | | | Tailing | | | |
|---|---|---|---|---|---|---|---|---|---|---|---|---|
| | Feed Assay | | Depressant | Percent | Assay | | Distribution | | Assay | | Distribution | |
| Example | % Cu | % $MoS_2$ | $Na_2CS_3$ (lbs./ton) | weight floated | % Cu | % $MoS_2$ | % Cu | % $MoS_2$ | % Cu | % $MoS_2$ | % Cu | % $MoS_2$ |
| 1A | 26.3 | 0.603 | — | 95.32 | Essentially no separation | | | | | | | |
| 2A | 26.3 | 0.603 | 6.0 | 17.43 | 27.12 | 2.350 | 18.2 | 69.1 | 25.80 | 0.222 | 81.8 | 30.9 |
| 3A | 26.3 | 0.603 | 8.0 | 13.53 | 23.59 | 3.280 | 12.5 | 75.5 | 25.91 | 0.167 | 87.5 | 24.5 |
| 4A | 26.3 | 0.603 | 10.0 | 13.82 | 23.18 | 3.310 | 12.5 | 78.7 | 26.01 | 0.144 | 87.5 | 21.3 |
| 1B | 21.5 | 0.380 | — | 97.48 | Essentially no separation | | | | | | | |
| 2B | 21.5 | 0.380 | 8.3 | 14.08 | 22.2 | 1.60 | 15.3 | 59.3 | 20.2 | 0.18 | 84.7 | 40.7 |
| 3B | 21.5 | 0.380 | 11.0 | 16.55 | 21.7 | 1.60 | 16.8 | 69.7 | 21.3 | 0.14 | 83.2 | 30.3 |

TABLE I-continued

| | Copper Concentrate | | | | Molybdenite Concentrate | | | | Tailing | | | |
|---|---|---|---|---|---|---|---|---|---|---|---|---|
| | Feed Assay | | Depressant $Na_2CS_3$ | Percent weight | Assay | | Distribution | | Assay | | Distribution | |
| Example | % Cu | % $MoS_2$ | (lbs./ton) | floated | % Cu | % $MoS_2$ | % Cu | % $MoS_2$ | % Cu | % $MoS_2$ | % Cu | % $MoS_2$ |
| 1C | 23.3 | 0.372 | 3.5 | 20.62 | 30.07 | 1.003 | 26.7 | 58.1 | 21.44 | 0.188 | 73.3 | 41.9 |
| 1D | 19.0 | 0.650 | — | 98.43 | Essentially no separation | | | | | | | |
| 2D | 19.0 | 0.650 | 1.3 | 4.67 | 21.5 | 12.0 | 5.4 | 88.0 | 18.3 | 0.08 | 94.6 | 12.0 |
| 3D | 19.0 | 0.650 | 2.7 | 9.75 | 28.5 | 6.0 | 15.7 | 91.5 | 16.6 | 0.06 | 84.3 | 8.5 |
| 1E | 22.0 | 0.50 | 2.7 | 12.31 | 23.1 | 3.2 | 13.1 | 91.8 | 21.6 | 0.04 | 86.9 | 8.2 |
| 2E | 22.0 | 0.50 | 5.3 | 15.99 | 21.4 | 2.0 | 15.1 | 90.5 | 21.7 | 0.04 | 84.9 | 9.5 |
| 1F | 25.3 | 1.80 | 1.8 | 26.80 | 33.9 | 6.8 | 36.0 | 96.9 | 22.1 | 0.08 | 64.0 | 3.1 |
| 2F | 25.3 | 1.80 | 3.6 | 30.78 | 32.6 | 5.0 | 39.5 | 96.9 | 22.2 | 0.07 | 60.5 | 3.1 |
| 1G | 33.2 | 0.803 | — | — | Essentially no separation | | | | | | | |
| 2G | 33.2 | 0.803 | 1.5 | 12.04 | 35.2 | 6.3 | 12.8 | 94.5 | 32.7 | 0.050 | 87.2 | 5.5 |
| 1H | 23.5 | 0.730 | — | — | Essentially no separation | | | | | | | |
| 2H | 23.5 | 0.730 | 1.5 | 14.09 | 26.3 | 4.8 | 16.0 | 92.9 | 22.7 | 0.060 | 84.0 | 7.1 |

The copper concentrates of the series A and series B examples were conditioned for two-five minutes with the indicated quantity of disodium trithiocarbonate at a pH of from 11.4 to 12.2. Thereafter molybdenite was recovered as an enriched concentrate by flotation of the conditioned pulp for five minutes.

The series C example copper concentrate was adjusted to a pH of 6.5 and zinc sulfate was then added at a rate of 1.5 pounds per ton and the concentrate was conditioned for ten minutes at pH 6.5. Hydrogen peroxide was then added at a rate of one pound per ton and the concentrate was conditioned for five minutes at pH 6.5. Thereafter, the indicated quantity of disodium trithiocarbonate was added giving the concentrate a pH of 8.5 and the concentrate was conditioned for five minutes. Following conditioning with the depressant molybdenite was recovered as an enriched concentrate by flotation of the conditioned pulp for five minutes.

The copper concentrates of the series D examples were acidified to a pH of 6.0 to 6.5 and conditioned for 10–15 minutes. The indicated quantity of disodium trithiocarbonate was added and the concentrate conditioned for five minutes at the resulting pH of 8.5 to 9.0. Molybdenite was recovered as an enriched concentrate by flotation of the conditioned pulp for five minutes.

The copper concentrates of the series E and F examples were acidified to a pH of 6.0 to 6.5 and conditioned for five minutes. Thereafter, the indicated quantity of disodium trithiocarbonate was added and the concentrate was conditioned for five minutes at the resulting pH of from 7.3 to 9.8. Molybdenite was recovered as an enriched concentrate by flotation for five minutes of examples 1E–2E and 1F and for flotation for ten minutes of example 2F.

In th series G and H examples the concentrate pulp was steamed at 35°–40° C. for fifteen minutes. The pH of the steam stripped concentrate was adjusted to 6.0 to 6.5 and the concentrate was allowed to condition for 10–15 minutes. Thereafter, the indicated quantity of disodium trithiocarbonate was added and the concentrate was condition for five minutes at the resulting pH of 8.5 to 9.0. Molybdenium was recovered as an enriched concentrate by flotation for five minutes.

In Table II which follows, examples 1I–2I and 1J–2J illustrate the use of disodium trithiocarbonate as a copper depressant wherein an inert gas, nitrogen, was employed to effect flotation. Example 2K illustrates the effectiveness of diammonium trithiocarbonate as a copper depressant and compares it to disodium trithiocarbonate at comparable dosage levels.

TABLE II

| | Copper Concentrate | | | | Molybdenite Concentrate | | | | Tailing | | | |
|---|---|---|---|---|---|---|---|---|---|---|---|---|
| | Feed Assay | | Depressant $Na_2CS_3$ | Percent weight | Assay | | Distribution | | Assay | | Distribution | |
| Example | % Cu | % $MoS_2$ | (lbs./ton) | floated | % Cu | % $MoS_2$ | % Cu | % $MoS_2$ | % Cu | % $MoS_2$ | % Cu | % $MoS_2$ |
| 1I | 33.0 | 0.560 | 2.0 | 12.12 | 35.1 | 4.2 | 13.0 | 93.5 | 32.3 | 0.04 | 87.0 | 6.5 |
| 2I | 33.0 | 0.560 | 2.0 | 12.00 | 35.0 | 4.4 | 12.7 | 96.0 | 32.7 | 0.03 | 87.3 | 4.0 |
| 1J | 25.5 | 0.380 | 2.0 | 14.30 | 26.2 | 2.3 | 14.8 | 88.5 | 25.1 | 0.05 | 85.2 | 11.5 |
| 2J | 25.5 | 0.380 | 2.0 | 14.10 | 27.0 | 2.4 | 14.9 | 91.5 | 25.3 | 0.04 | 85.1 | 8.5 |
| 1K | 19.5 | 0.300 | 2.0 | 8.84 | 25.0 | 3.0 | 11.6 | 87.9 | 18.5 | 0.04 | 88.4 | 12.1 |
| | | | $(NH_4)_2CS_3$ | | | | | | | | | |
| 2K | 19.5 | 0.300 | 2.0 | 15.13 | 32.0 | 1.7 | 26.3 | 75.0 | 16.0 | 0.10 | 73.7 | 25.0 |

In the series I and J examples, the copper concentrate was acidified to a pH of 6.0 to 6.5 and conditioned for 10–15 minutes. The indicated quantity of disodium trithiocarbonate was added and the concentrate was conditioned for 5 minutes at the resulting pH of 8.5 to 9.0. Molybdenite was recovered as an enriched concentrate by flotation for 5 minutes. In examples 2I and 2J nitrogen was substituted for air to effect flotation.

In the series K examples, the copper concentrate was acidified to a pH of 6.0 to 6.5 and conditioned for 10–15 minutes. The indicated quantity of depressant was added—example 1K being disodium trithiocarbonate and example 2K being diammonium trithiocarbonate and the concentrate was conditioned for five minutes at the resulting pH of 7.5 to 8.0. Thereafter, molybdenite was recovered as an enriched concentrate by flotation of the pulp for 5 minutes.

The invention as described above has been set forth in terms of its preferred embodiments. It should be understood that one of ordinary skill in this art may take various changes and other modifications to the above-described method without departing from the scope or spirit of the inventive subject matter as particularly pointed out above or claimed hereafter.

We claim:

1. A process for recovering molybdenite from a flotation concentrate containing molybdenite and copper sulfide, comprising:

contacting the concentrate with an effective amount of dithiocarbonic acid, trithiocarbonic acid, water soluble salts of dithiocarbonic acid or trithiocarbonic acid, or mixtures thereof, to depress copper sulfide; and subjecting the treated concentrate to froth flotation to differentially float and concentrate molybdenite.

2. The process of claim 1, wherein the concentrate is contacted with trithiocarbonic acid.

3. The process of claim 1, wherein the concentrate is contacted with a water soluble salt of trithiocarbonic acid.

4. The process of claim 3, wherein the salt is an alkali metal salt, alkaline earth metal salt or an ammonium salt of trithiocarbonic acid.

5. The process of claim 4, wherein the salt is a single, double or mixed double sodium, potassium or ammonium salt of trithiocarbonic acid.

6. The process of claim 3, wherein the salt is disodium trithiocarbonate.

7. The process of claim 3, wherein the salt is dipotassium trithiocarbonate.

8. The process of claim 3, wherein the salt is potassium sodium trithiocarbonate.

9. The process of claim 3, wherein the salt is magnesium trithiocarbonate or calcium trithiocarbonate.

10. The process of claim 3, wherein the salt is diammonium trithiocarbonate.

11. The process of claim 3, wherein the trithiocabonate salt is a mixed double salt of ammonium and an alkali metal.

12. The process of claims 3, 4, 5, 6, 7, 8, 9, 10 or 11 wherein the concentrate is a copper concentrate and the concentrate is contacted with the trithiocarbonate salt in an amount ranging from about one-fourth to about fifty pounds per ton of concentrate solids.

13. The process of claim 12, wherein after contacting with the trithiocarbonate salt the concentrate is conditioned for from about one-half to about 30 minutes at a pH of from about 5 to about 12 before subjecting the treated concentrate to froth flotation.

14. The process of claim 12, wherein after contacting with the trithiocarbonate salt the concentrate is conditioned for from about one-half to about 30 minutes at a pH of from about 7 to about 10 before subjecting the treated concentrate to froth flotation.

15. The process of claim 12, wherein the trithiocarbonate salt is contacted with th concentrate in an amount ranging from about one-half to about 15 pounds per ton of concentrate solids.

16. The process of claim 15, wherein the concentrate is acidified to a pH of from about 2.0 to about 7.0 prior to contacting with the trithiocarbonate salt.

17. The process of claim 15, wherein the concentrate is acidified to a pH of from about 5.5 to about 6.5 prior to contacting with the trithiocarbonate salt.

18. The process of claim 15, wherein the concentrate is stripped of organic collector reagents prior to contacting with the trithiocarbonate salt.

* * * * *

UNITED STATES PATENT AND TRADEMARK OFFICE

CERTIFICATE OF CORRECTION

PATENT NO. : 4,425,230

DATED : January 10, 1984

INVENTOR(S) : Carlos Andress; William F. Riggs

It is certified that error appears in the above-identified patent and that said Letters Patent are hereby corrected as shown below:

In Column 1, Line 18
delete "surface" and insert therein --surfaces--.

In Column 2, Line 28
delete "or alone or" and insert therein -- or alone on--.

In Column 3, Line 27
delete "molybdenite of bearing" and insert therein --molybdenite bearing--.

In Column 4, Line 2
delete "hydrosulfite" and insert therein --hydrosulfide--.

In Column 5, Line 3
delete "C." and insert therein --C--.

In Column 6, Line 36
elete "xanthate and alkyl" under the 'Example Series' heading and
nsert -- xanthate and alkyl -- under the 'Major Reagents' heading.

In Column 6, Line 47
delete "1 C" and insert therein --1C--.

In Column 7, Line 65
delete "th" and insert therein --the--.

In Column 8, Line 21
delete "Molybdenium" and insert therein --Molybdenite--.

In Column 8, Line 63
delete "take" and insert therein --make--.

UNITED STATES PATENT AND TRADEMARK OFFICE

CERTIFICATE OF CORRECTION

PATENT NO. : 4,425,230 Page 2 of 2

DATED : January 10, 1984

INVENTOR(S) : Carlos Andress et al.

It is certified that error appears in the above-identified patent and that said Letters Patent is hereby corrected as shown below:

Column 10, line 20, delete "th" and insert therein -- the --.

Signed and Sealed this

*Eighth* Day of *May 1984*

[SEAL]

*Attest:*

GERALD J. MOSSINGHOFF

*Attesting Officer*

*Commissioner of Patents and Trademarks*